US008155546B2

(12) United States Patent
Fukase

(10) Patent No.: US 8,155,546 B2
(45) Date of Patent: Apr. 10, 2012

(54) IMAGE FORMING APPARATUS

(75) Inventor: Yasuhiro Fukase, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 301 days.

(21) Appl. No.: 12/632,085

(22) Filed: Dec. 7, 2009

(65) Prior Publication Data

US 2010/0150586 A1 Jun. 17, 2010

(30) Foreign Application Priority Data

Dec. 12, 2008 (JP) ..... 2008-317226

(51) Int. Cl.
*G03G 15/08* (2006.01)

(52) U.S. Cl. ..... 399/53; 399/227

(58) Field of Classification Search ..... 399/53, 399/54, 227

See application file for complete search history.

(56) References Cited

U.S. PATENT DOCUMENTS 6,226,481 B1 * 5/2001 Yoneda et al. ..... 399/227
7,155,147 B2 * 12/2006 Wakahara ..... 399/227
2008/0286011 A1 11/2008 Aoki et al.

FOREIGN PATENT DOCUMENTS

JP 9-185308 A 7/1997
JP 2000-181290 A 6/2000
JP 2000-330444 A 11/2000
JP 2006-162745 A 6/2006

* cited by examiner

*Primary Examiner* — Hoang Ngo

(74) *Attorney, Agent, or Firm* — Fitzpatrick, Cella, Harper & Scinto

(57) ABSTRACT

An image forming apparatus includes an image bearing member; a plurality of developing devices, contactable to the image bearing member, for developing a latent image on the image bearing member with toner; a rotatable member for rotatably supporting the plurality of developing devices; a detecting device for detecting a position of the image bearing member, wherein on the basis of an output of the detecting device, the rotatable member is rotated; and a control device for changeably controlling a period from timing of detection by the detecting device to timing of contact of one of the plurality of developing device, rotated by the rotatable member, to the image bearing member.

12 Claims, 4 Drawing Sheets

IMAGE FORMING APPARATUS

FIELD OF THE INVENTION AND RELATED ART

The present invention relates to an image forming apparatus, such as a copying machine, a multi-function machine, or a laser beam printer, capable of forming a color image by using an electrophotographic method or an electrostatic recording method.

For example, a color image forming apparatus of an electrophotographic type can be roughly classified into two types including a one-cycle type image forming apparatus and a four-cycle image forming apparatus.

In the one-cycle type image forming apparatus including an image forming portion for each color, a constitution of a type of directly transferring a toner image from an image bearing member onto a transfer material or of a type of primary-transferring the toner image onto an intermediary transfer member and then secondary-transferring the toner image from the intermediary transfer member onto the transfer material goes mainstream.

On the other hand, in the four-cycle type image forming apparatus in which commonality of respective color image forming portions other than developing devices is principally achieved, a first color toner image is formed on the image bearing member by a developing device for the first color and then is primary-transferred from the image bearing member onto the intermediary transfer member. Next, the developing device for the first color is moved apart from the image bearing member and a developing device for a second color is brought into contact with the image bearing member, and the second color toner image is formed on the developing device for the second color and then is primary-transferred from the image bearing member onto the first color toner image on the intermediary transfer member in a superposition manner. This process is repeated for each of remaining colors and thereafter the resultant toner images are secondary-transferred from the intermediary transfer member onto the transfer material. With respect to the four-color type image forming apparatus, the above-described constitution goes mainstream.

As a switching constitution of the developing devices with respect to the image bearing member, there is a rotary type constitution in which a rotatable member holds the developing devices for the respective colors and is rotated by a predetermined angle to effect the switching. As another constitution, there is also a constitution in which the developing devices for the respective colors are substantially fixed above a circumferential (peripheral) surface of a large-diameter image bearing member and each developing device is somewhat moved to contact the image bearing member or moved apart from the image bearing member.

Further, with respect to the superposition of the respective color toner images on the intermediary transfer member, in order to reduce a degree of color misregistration, the following constitution has been proposed.

That is, a circumferential length of the intermediary transfer member is configured to be a substantially integer multiple of a circumferential length of the image bearing member and a position detecting portion such as a seal applied onto the intermediary transfer member is detected by a sensor or the like, and the toner image is formed for each color on the basis of a detected signal for the position detecting portion.

In this constitution, a primary transfer position and a secondary transfer position on the intermediary transfer member are always the substantially same position. For that reason, in some cases, image defect is caused by damage of the intermediary transfer member due to rubbing between the intermediary transfer member and the image bearing member at the primary transfer position, rubbing between the intermediary transfer member and a secondary transfer roller at the secondary transfer position by their contact and separation, electric discharge at the primary transfer portion or the secondary transfer portion, a656nd the like.

For this reason, as described in Japanese Laid-Open Patent Application (JP-A) 2000-330444, a constitution in which the primary transfer position, the secondary transfer position, and the like on the intermediary transfer member are changed every print job is employed.

In this case, however, there arises the following problem.

That is, in a rotary type constitution described in JP-A 2000-330444, the constitution in which the primary transfer position, the secondary transfer position, and the like on the intermediary transfer member are changed every print job is employed and the circumferential length of the intermediary transfer member is configured to be the substantially integer multiple of the circumferential length of the image bearing member. For that reason, unless rotation timing of the rotatable member for holding the developing devices is changed, each of developing rollers for the developing devices for the respective colors always contacts the image bearing member at the substantially same position.

Due to impact of contact during this contact or repetition of the contact, a surface of the image bearing member is mechanically damaged or is electrically damaged by rubbing (sliding) memory, so that the image defect has been caused to occur in some cases.

Further, the image bearing member is fluctuated in speed by the contact impact during the contact, so that rubbing is caused to occur at a contact portion between the image bearing member and the intermediary transfer member. By repetition of the contact impact or the rubbing, in some cases, the image defect has been caused to occur due to the mechanical damage of the image bearing member surface or the electrical damage such as the rubbing memory of the image bearing member surface.

SUMMARY OF THE INVENTION

A principal object of the present invention is to provide an image forming apparatus capable of reducing image defect caused by contact of a plurality of developing devices with a image bearing member always at the same position.

According to an aspect of the present invention, there is provided an image forming apparatus comprising:

an image bearing member;

a plurality of developing devices, contactable to the image bearing member, for developing a latent image on the image bearing member with toner;

a rotatable member for rotatably supporting the plurality of developing devices;

a detecting device for detecting a position of the image bearing member, wherein on the basis of an output of the detecting device, the rotatable member is rotated; and a control device for changeably controlling a period from timing of detection by the detecting device to timing of contact of one of the plurality of developing device, rotated by the rotatable member, to the image bearing member.

According to another aspect of the present invention, there is provided an image forming apparatus comprising:

an image bearing member;

a plurality of developing devices, contactable to the image bearing member, for developing a latent image on the image bearing member with toner;

a rotatable member for rotatably supporting the plurality of developing devices;

an intermediary transfer member onto which a toner image formed on the image bearing member is to be transferred, wherein the toner image on the intermediary transfer member is to be transferred onto a recording material;

a detecting device for detecting a position of the intermediary transfer member, wherein on the basis of an output of the detecting device, the rotatable member is rotated; and a control device for changeably controlling a period from timing of detection by the detecting device to timing of contact of one of the plurality of developing device, rotated by the rotatable member, to the image bearing member.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Hereinbelow, the image forming apparatus according to the present invention will be described with reference to the drawings.

Figure 1:
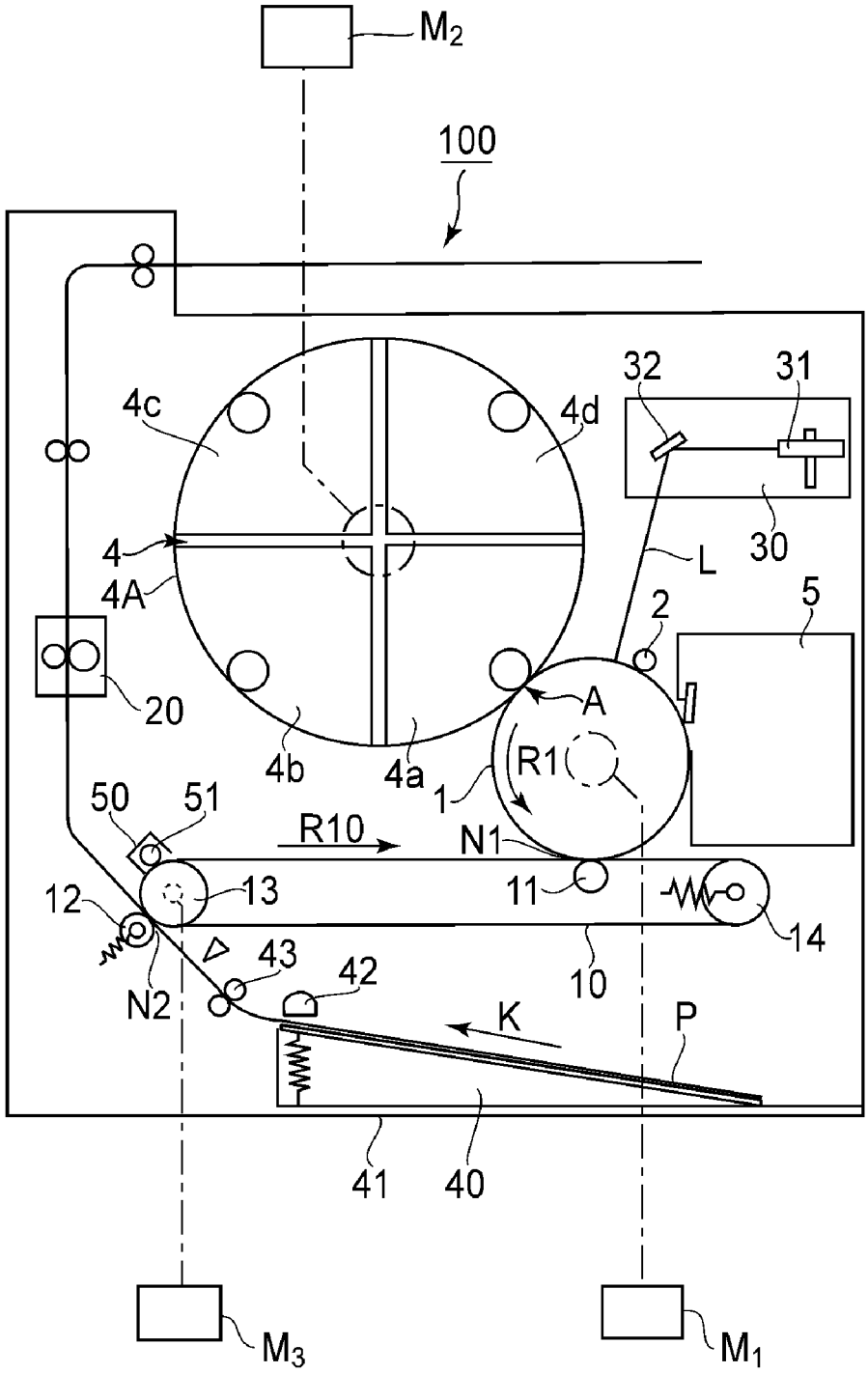
FIG. 1 is a schematic view showing an image forming apparatus as an embodiment of the present invention.
Figure 2:
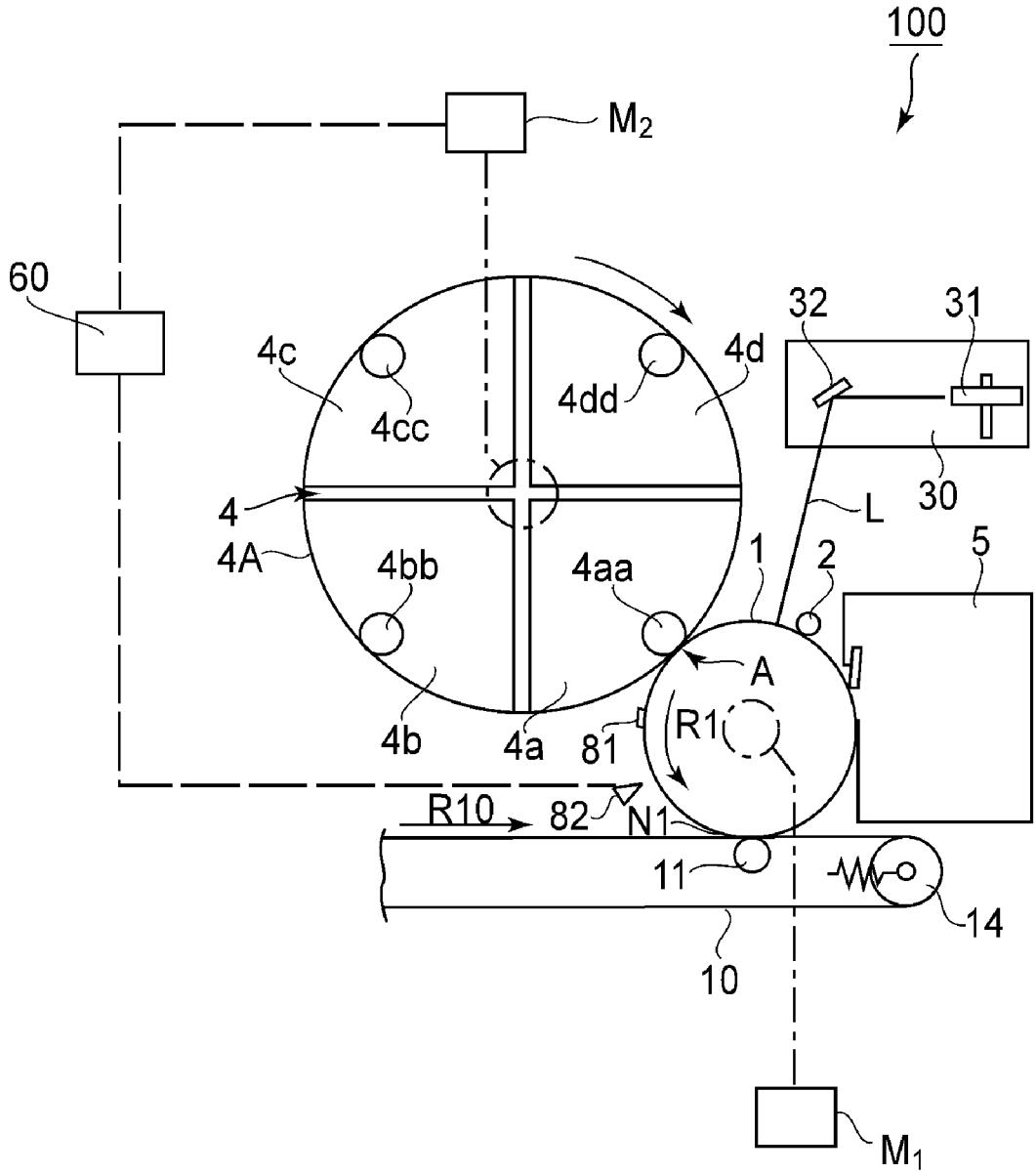
FIG. 2 is a schematic view showing a principal part of the image forming apparatus.

FIG. 1 shows an embodiment of the image forming apparatus according to the present invention and is longitudinal sectional view showing a schematic structure of an image forming apparatus 100 according to the present invention.

The image forming apparatus 100 in this embodiment shown in FIG. 1 is a four color (four path)-based full-color laser beam printer of an electrophotographic type in which an intermediary transfer member is utilized. A constitution of the image forming apparatus 100 will be briefly described below.

The image forming apparatus 100 in this embodiment includes a drum-type electrophotographic photosensitive member (hereinafter referred to as a "photosensitive drum") 1 as a first image bearing member (image carrying member). The photosensitive drum 1 is rotatably supported by an apparatus main assembly and is rotationally driven in a direction indicated by an arrow R1 by a driving means M1. That is, the photosensitive drum 1 has an endless shape. Around the photosensitive drum 1, along its rotational direction, a charging roller 2 as a charging means of a contact type for uniformly charging the surface of the photosensitive drum 1 and an exposure device 30 for forming an electrostatic latent image on the surface of the photosensitive drum 1 by irradiating the surface of the photosensitive drum 1 with laser light L correspondingly to image information are disposed.

Further, around the photosensitive drum 1, a developing device (developing apparatus) 4 for developing the electrostatic latent image into a toner image by depositing toner onto the electrostatic latent image formed on the photosensitive drum 1 and an intermediary transfer belt (intermediary transfer member) 10 as a second image bearing member (image carrying member) onto which the toner image is primary-transferred from the photosensitive drum 1 are disposed. The intermediary transfer belt 10 has the endless shape.

Further, around the photosensitive drum 1, a photosensitive drum cleaning device 5 for removing primary-transfer residual toner remaining on the surface of the photosensitive drum 1 is disposed.

Inside the intermediary transfer belt 10, a primary transfer roller 11 as a primary transfer means is disposed and urges the intermediary transfer belt 10 against the photosensitive drum 1 surface to form a primary transfer nip N1 between the photosensitive drum 1 and the intermediary transfer belt 10. To the primary transfer roller 11, a primary transfer bias is applied by a power source (not shown). Further, outside the intermediary transfer belt 10, a secondary transfer roller 12 as a secondary transfer means is disposed and forms a secondary transfer nip N2 between the secondary transfer roller 12 and the intermediary transfer belt 10. To the secondary transfer roller 12, a secondary transfer bias is applied by a power source (not shown).

Further, a cleaning roller (roller charger) 51 of an electrostatic intermediary transfer belt cleaning device 50 is disposed opposite to the intermediary transfer belt 10.

Further, on a downstream side of the secondary transfer nip N2 with respect to a conveyance direction (indicated by an arrow K) of a transfer material P which is a recording material, a fixing device 20 for fixing the toner image transferred onto the transfer material P by heating and pressure application is disposed.

Next, the respective constituent elements of the image forming apparatus 100 in this embodiment will be specifically described.

The photosensitive drum 1 is constituted by providing a photoconductive layer of organic photoconductor (OPC), amorphous silicon (α-Si), or the like on an outer circumferential surface of an aluminum cylinder.

The charging roller 2 is constituted by a core metal and an electroconductive elastic member surrounding the core metal and is disposed in contact to the surface of the photosensitive drum 1. The charging roller 2 is rotated by the rotation of the photosensitive drum 1 and is supplied with a charging bias by a power source (not shown).

The exposure device 30 as an exposure means includes a laser oscillator (not shown) for emitting the laser light L correspondingly to the image information, a polygonal mirror 31, a mirror 32, and the like, and the charged surface of the photosensitive drum 1 is exposed to the laser light L correspondingly to the image information to form the electrostatic latent image thereon.

The developing device (developing apparatus) 4 includes a rotatable member 4A and four color developing devices, mounted to the rotatable member 4A, i.e., a yellow developing device 4*a*, a magenta developing device 4*b*, a cyan developing device 4*c*, and a back developing device 4*d*. By rotating the rotatable member 4A by a driving means M2, the developing device (the yellow developing device 4*a* in FIG. 1) is disposed at a developing position A, where the developing device 4*a* opposes the photosensitive drum 1 surface, in order to be subjected to the development of the electrostatic latent image on the photosensitive drum 1. That is, the rotatable member 4A rotatably supports the plurality of developing devices.

During the four color-based full-color image formation, the respective developing devices are successively disposed at the developing position A. The plurality of developing devices 4*a*, 4*b*, 4*c* and 4*d* include developing rollers 4*aa*, 4*bb*, 4*cc* and 4*dd*, respectively, as a developing member. Each of the developing rollers 4*aa* to 4*dd* contacts the photosensitive drum 1 at the developing position A.

The intermediary transfer belt 10 is formed in the endless shape and is extended around two supporting rollers, which are disposed in parallel with each other, i.e., a driving roller 13 and a tension roller 14. The tension roller 14 is rotated by the rotation of the intermediary transfer belt 10 and stretches the intermediary transfer belt 10. The intermediary transfer belt 10 is rotated (moved) in a direction indicated by an arrow R10 by drive of the driving roller by a driving means M3. As a specific material of the intermediary transfer belt 10, it is possible to use a 50-200 μm thick film, having a volume resistivity of $10^8$ to $10^{16}$ ohm·cm, of polyvinylidene fluoride (PVDF), polyethylene-tetrafluoroethylene (ETFE), polyimide, polyethylene terephthalate (PET), polycarbonate, and the like, and a 0.5-2 mm thick rubber-based film of EPDM.

On the inner circumferential surface of the intermediary transfer belt 10, the above-described primary transfer roller 11 is disposed substantially opposite to the photosensitive drum 1 and urges the intermediary transfer belt 10 against the photosensitive drum 1 surface to form the primary transfer nip N1. Further, on the outer circumferential surface of the intermediary transfer belt 10 and at the position where the above-described secondary transfer roller 12 opposes the driving roller 13, the secondary transfer roller 12 is disposed and forms the secondary transfer nip N2 between the surface of the secondary transfer roller 12 and the intermediary transfer belt 10. Further, on the downstream side of the secondary transfer nip N2 and on the upstream side of the primary transfer nip N1, the above-described electrostatic intermediary transfer belt cleaning device 50 is disposed opposite to the surface of the intermediary transfer belt 10. The electrostatic intermediary transfer belt cleaning device 50 includes a cleaning roller (roller charger) 51 disposed on the surface of the intermediary transfer belt 10 and includes an AC power source (not shown) and a DC power source (not shown) which are connected with the cleaning roller 51.

A transfer material feeding device 40 feeds the transfer material P to the image forming portion and is constituted by including a transfer material cassette 41 accommodating there in a plurality of sheets of the transfer material P, a feeding roller 42, registration rollers 43, and the like.

Next, an operation of the above-constituted image forming apparatus will be described.

To the photosensitive drum 1 rotationally driven in the direction indicated by an arrow R1, the charging bias in the form of a DC voltage biased with an AC voltage is applied, so that the surface of the photosensitive drum 1 is electrically charged uniformly. When an image signal for yellow is input into the laser oscillator (not shown), the charged surface of the photosensitive drum 1 is irradiated with the emitted laser light L and thus the electrostatic latent image is formed. When the photosensitive drum 1 is rotated further in the arrow R1 direction, onto the electrostatic latent image on the photosensitive drum 1, yellow toner is deposited by the yellow developing device 4*a* to develop the electrostatic latent image as a yellow toner image. The yellow toner image on the photosensitive drum 1 is primary-transferred onto the intermediary transfer belt 10 through the primary transfer nip N1 by the primary transfer bias applied to the primary transfer roller 11. The primary transfer residual toner remaining on the photosensitive drum 1 surface after the primary transfer of the toner image is removed by the photosensitive drum cleaning device 5 and is subjected to subsequent image formation.

A series of image forming process including the charging, the exposure, the development, the primary transfer, and the cleaning described above is repeated with respect to other three colors, i.e., magenta, cyan and black, so that the four color toner images are formed on the intermediary transfer belt 10.

The four color toner images on the intermediary transfer belt 10 are secondary-transferred onto the transfer material P conveyed in the direction indicated by the arrow K through the secondary transfer nip N2 by the secondary transfer bias applied from the power source to the secondary transfer roller 12.

The transfer material P on which the toner images are transferred through the secondary transfer nip N2 is conveyed into the fixing device 20 in which the toner images are heated and pressed and thus are melt-fixed, so that a full-color image is formed on the transfer material P.

On the other hand, on the intermediary transfer belt 10 after the toner image transfer, secondary transfer residual toner which has not been transferred onto the transfer material P remains. The residual toner on the intermediary transfer belt 10 is collected by the photosensitive drum cleaning device 5 through the photosensitive drum 1 by the intermediary transfer belt cleaning device 50.

That is, the electric charge of an opposite polarity to the charge polarity of the toner, i.e., a position polarity is imparted to the residual toner by the intermediary transfer belt cleaning means, so that the residual toner is reversely transferred onto the photosensitive drum 1 through the primary transfer nip N1. The reversely transferred secondary transfer residual toner is removed together with the primary transfer residual toner on the photosensitive drum 1 by the photosensitive drum cleaning device 5.

Next, with reference to FIG. 5, a constitution of a characterizing portion of the image forming apparatus 100 in this embodiment will be described.

When the toner image for the first color is formed, a portion-to-be-detected 81 disposed in a non-image area on the photosensitive drum 1 is detected by a reflection sensor 82 to acquire a rotational position (angular position) of the photosensitive drum 1. That is, a detecting device is constituted by the portion-to-be-detected 81 and the reflection sensor 82.

On the basis of a detection signal of the reflection sensor 82, the rotatable member 4A of the developing device 4 is rotated by the driving means M2 and the yellow developing device 4*a* is moved to the developing position A. Further, on the basis of the detection signal of the reflection sensor 82, the laser light L irradiation from the exposure device 30 is started after the lapse of a predetermined time, so that the electrostatic latent image is formed on the photosensitive drum 1 and then is developed into the toner image by the yellow developing device 4*a*. That is yellow toner image is primary-transferred from the photosensitive drum 1 onto the intermediary transfer belt 10.

The toner images for the second to fourth colors to be superposed on the yellow toner image are formed in the following manner.

First, the position of a leading edge of the toner image for the first color is acquired from a detection time of the portion-to-be-detected 81 on the photosensitive drum 1 by the reflection sensor 82 and a circumferential length of the photosensitive drum 1.

On the basis of a detection signal after detection is performed predetermined times from a reference detection signal of the reflection sensor 82 for the first color, the rotatable member 4A of the developing device 4 is rotated to move the magenta developing device 4*b* to the detecting position A. Further, on the basis of the detection signal of the reflection sensor 82, after the lapse of a predetermined time, the laser light L irradiation from the exposure device 30 is started, so that the electrostatic latent image is formed on the photosensitive drum 1 and is developed into the magenta toner image by the magenta developing device 4*b*. Thus magenta toner image is primary-transferred from the photosensitive drum 1 onto the intermediary transfer belt 10.

This image forming step is repeated with respect to the third color of cyan and the fourth color of black and thereafter, i.e., after the four color toner images are superposed on the intermediary transfer belt 10, the secondary transfer of the toner images onto the transfer material P is performed.

Next, with reference to FIGS. 3(*a*) and 3(*b*), a method of changing rotation timing of the rotatable member 4A in this embodiment will be described. Incidentally, a reference numeral 60 represents a control device for controlling the constitutional elements in the apparatus main assembly.

The portion-to-be-detected 81 on the photosensitive drum 1 is detected by the reflection sensor 82 and the detected signal (timing) as the reference of the rotation timing of the rotatable member 4A or irradiation timing of the laser light L for each color (i.e., image writing (forming) toner image. Now, as shown in FIG. 3(*a*), a time from the reference detection signal to the rotation start of the rotatable member is taken as E (sec) and a time from the reference detection signal to the irradiation start of the laser light L is taken as D (sec). The image formation on a first sheet in one print job is effected with the above timings (FIG. 3(*a*)).

Figure 3:
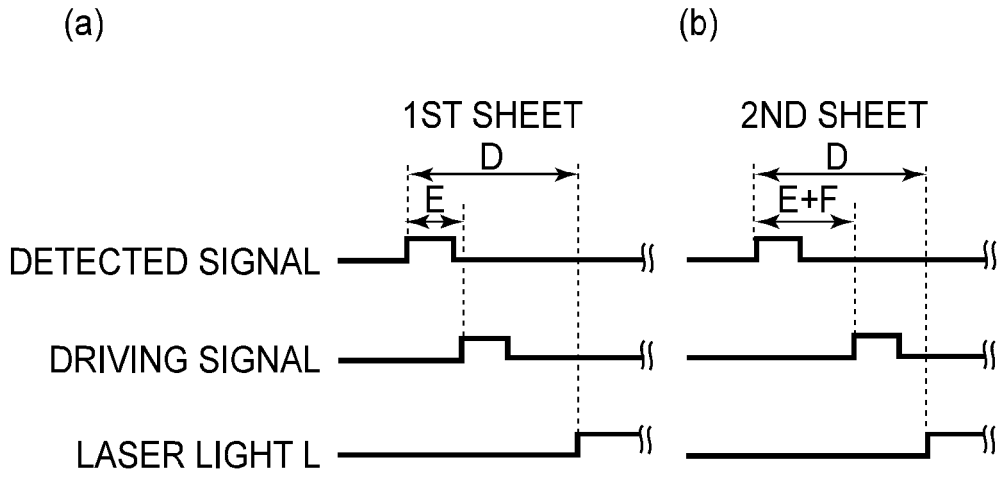
FIGS. 3(*a*) and 3(*b*) are schematic views for illustrating a sequence in the embodiment.

As shown in FIG. 3(*b*), the image formation on a second sheet is effected with timing of (E+F) (sec) which is a time from the reference detection signal to the rotation start of the rotatable member 4A and with timing of D (sec) which is a time from the reference detection signal to the irradiation start of the laser light L. That is, the control device changeably controls a period from the detect timing of the detecting device to timing at which one of the plurality of developing devices contacts the photosensitive drum 1 by being rotated by the rotatable member 4A. In this embodiment, the control device changes the start timing of the rotation of the rotatable member 4A on the basis of the detection timing of the detecting device.

For example, when a process speed (an outer circumferential speed of the photosensitive drum 1) is 100 mm/sec and F is 0.05 sec, the start of the image formation on the second sheet is changed by 5 mm in contact position of the developing roller (4*aa* to 4*dd*) of each developing device on the photosensitive drum 1 since the rotation start time of the rotatable member 4A is delayed for 0.05 sec.

Thus, a value of F is changed within D (sec), at the developing position A, the contact position of the developing roller (4*aa* to 4*dd*) of each developing device on the photosensitive drum 1 is changed. In this embodiment, the value of F is changed every print number (i.e., every image formation). That is, the control device changes the period from the detection timing to the contact timing in a recording material unit during continuous image formation.

The value of F may also be changed every print job. That is, the control device may also change the period in an image forming job unit.

Further, the value of F may be changed every image formation for each color during the one sheet printing. That is, the control device may change the period in the color of the toner images on the single recording material.

As a changing method, it is possible to use, e.g., a method in which F is set at, e.g., 0.02×n in consideration of variation in contact position caused by respective parts tolerances, mechanical and electrical tolerances or errors of, e.g., responsiveness and the like, and so on, and the value of n is changed every print job.

Incidentally, it is also possible to change the value of the image writing timing D within the range of not adversely affecting considerably the time until one sheet of the transfer material is discharged.

As described above, the value of F is changed, so that the contact position of the developing roller (4*aa* to 4*dd*) of each developing device on the photosensitive drum 1 is changed. As a result, the photosensitive drum 1 is not damaged mechanically or is not damaged electrically to result in rubbing memory or the like, due to the contact impact or the contact repetition at the time of contact when the developing roller (4*aa* to 4*dd*) of each developing device always contacts the photosensitive drum 1 at the substantially same position. Therefore, a degree of image defect such as latent stripes or the like caused by these damages can be alleviated without increasing cost. Further, the photosensitive drum 1 fluctuates in speed due to the contact impact during the contact.

As a result, the photosensitive drum 1 is not damaged mechanically or is not damaged electrically to result in rubbing memory or the like, due to the rubbing or repetition of rubbing caused between the photosensitive drum 1 and the intermediary transfer belt 10 in the primary transfer nip N1. Therefore, a degree of image defect such as latent stripes or the like caused by these damages can be alleviated without increasing cost. Further, the photosensitive drum 1 fluctuates in speed due to the contact impact during the contact.

Further, the contact position of the developing roller (4*aa* to 4*dd*) of each developing device with the photosensitive drum 1 is changed and distributed, so that durability of the photosensitive drum 1 can be improved.

Further, the cost is not increased and the color misregistration is also not caused to occur.

Next, another embodiment of the image forming apparatus according to the present invention will be described. The general constitution of the image forming apparatus is similar to that of the image forming apparatus described in the above embodiment with reference to FIG. 1, thus being omitted from redundant description.

Figure 4:
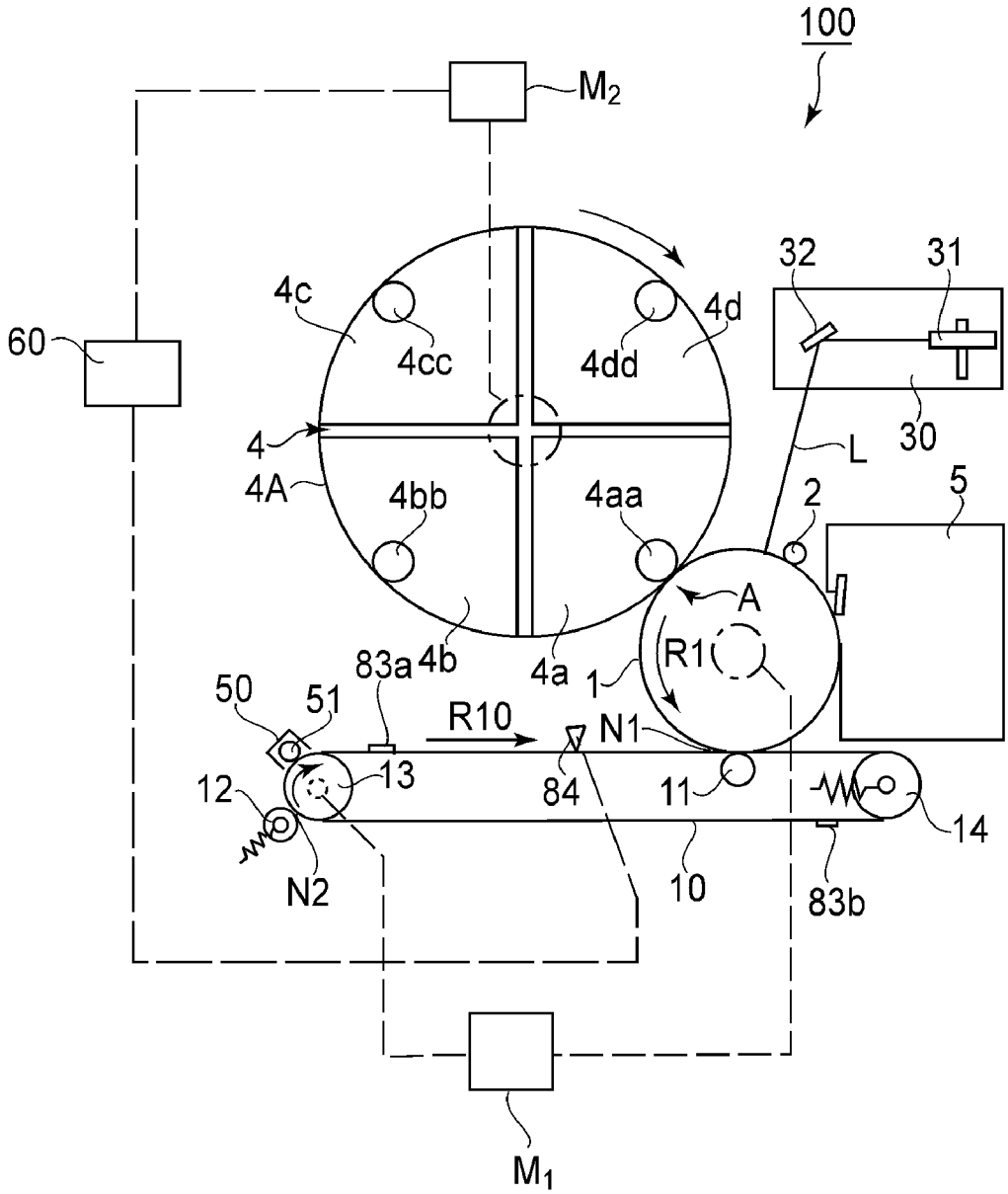
FIG. 4 is a schematic view showing an image forming apparatus as another embodiment of the present invention.

With reference to FIG. 4, a characterizing constitution of the image forming apparatus in this embodiment will be described below.

In this embodiment, the photosensitive drum 1 and the intermediary transfer belt 10 are configured to be driven by the same driving source M1 such as a motor.

Further, in order to alleviate the color misregistration, a circumferential length Lt is configured to be integer multiple or substantially integer multiple of a circumferential length Ld, i.e., Lt≈n×Ld (n: integer).

When the toner image for the first color is formed, portions-to-be-detected 83*a* and 83*b* disposed in the non-image area on the intermediary transfer belt 10 are detected by a reflection sensor 84 and on the basis of a detection signal, the rotatable member 4A is rotated by the driving means M2 to move the yellow developing device 4*a* to the developing position A. In this embodiment, as a detecting portion, the two portions-to-be-detected 83*a* and 83*b* are provided but the present invention is not limited thereto.

Further, on the basis of the detection signal of the reflection sensor 84, the laser light L irradiation from the exposure device 30 is started after the lapse of a predetermined time, so that the electrostatic latent image is formed on the photosensitive drum 1 and then is developed into the toner image by the yellow developing device 4*a*. That is yellow toner image is primary-transferred from the photosensitive drum 1 onto the intermediary transfer belt 10.

The toner images for the second to fourth colors to be superposed on the yellow toner image are formed in the following manner.

First, in consideration of the number of the portions-to-be-detected 83*a* and 83*b* disposed on the intermediary transfer belt 10, the detecting portion (the portions-to-be-detected 83*a* and 83*b* in this embodiment) as the reference of the toner image formation for the first color is detected by the reflection sensor 84 and one full circumference of the intermediary transfer belt 10 is detected.

On the basis of a detection signal from the reflection sensor 84, similarly as in the case of the first color, the rotatable member 4A is rotated to move the magenta developing device 4*b* to the detecting position A. Further, after the lapse of a predetermined time from the detection signal, the laser light L irradiation from the exposure device 30 is started, so that the electrostatic latent image is formed on the photosensitive drum 1 and is developed into the magenta toner image by the magenta developing device 4*b*. Thus magenta toner image is primary-transferred from the photosensitive drum 1 onto the intermediary transfer belt 10.

Incidentally, the circumferential length Lt of the intermediary transfer belt 10 is configured to be the substantially integer multiple of the circumferential length Ld of the photosensitive drum 1, so that when the intermediary transfer belt 10 moves its one full circumference, the photosensitive drum 1 rotates by a distance which is the substantially integer multiple of the one full circumference. As a result, an irradiation start position of the laser light L goes to the substantially same position on the photosensitive drum 1.

This image forming step is repeated with respect to the third color of cyan and the fourth color of black and thereafter, i.e., after the four color toner images are superposed on the intermediary transfer belt 10, the secondary transfer of the toner images onto the transfer material P is performed.

Next, with reference to FIGS. 5(*a*) and 5(*b*), a method of changing rotation timing of the rotatable member 4A in this embodiment will be described.

The portions-to-be-detected 83*a* and 83*b* on the intermediary transfer belt 10 is detected by the reflection sensor 84 and the detected signal (timing) as the reference of the rotation timing of the rotatable member 4A or irradiation timing of the laser light L for each color (i.e., image writing (forming) toner image. Now, as shown in FIG. 5(*a*), a time from the reference detection signal to the rotation start of the rotatable member is taken as H (sec) and a time from the reference detection signal to the irradiation start of the laser light L is taken as G (sec). The image formation on a first sheet in one print job is effected with the above timings (FIG. 5(*a*)).

Figure 5:
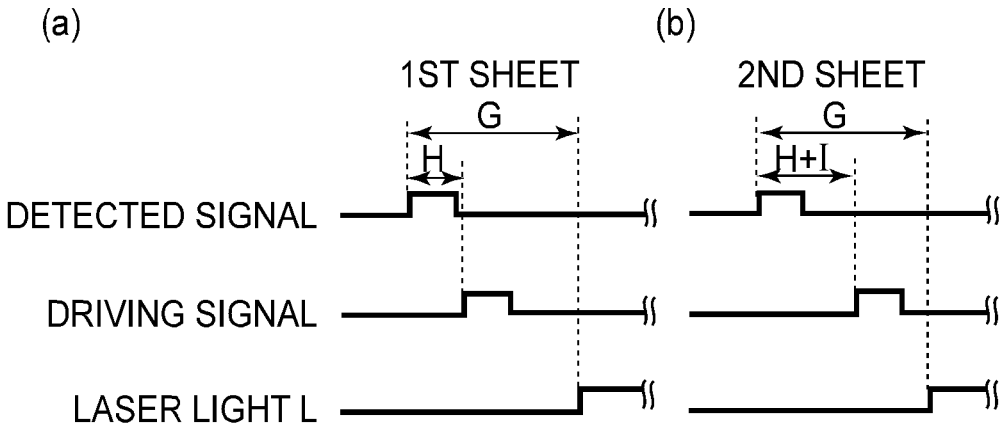
FIGS. 5(*a*) and 5(*b*) are schematic views for illustrating a sequence in another embodiment.

As shown in FIG. 5(*b*), the image formation on a second sheet is effected with timing of (H+I) (sec) which is a time from the reference detection signal to the rotation start of the rotatable member 4A and with timing of G (sec) which is a time from the reference detection signal to the irradiation start of the laser light L.

For example, when a process speed (an outer circumferential speed of the photosensitive drum 1) is 100 mm/sec and I is 0.05 sec, the start of the image formation on the second sheet is changed by 5 mm in contact position of the developing roller (4*aa* to 4*dd*) of each developing device on the photosensitive drum 1 at the developing position A since the rotation start time of the rotatable member 4A is delayed for 0.05 sec.

Thus, a value of I is changed within G (sec), at the developing position A, the contact position of the developing roller (4*aa* to 4*dd*) of each developing device on the photosensitive drum 1 is changed.

The value of I may also be changed every print job or every print number.

Further, the value of I may be changed every image formation for each color during the one sheet printing.

As a changing method, it is possible to use, e.g., a method in which I is set at, e.g., 0.02×n in consideration of variation in contact position caused by respective parts tolerances, mechanical and electrical tolerances or errors of, e.g., responsiveness and the like, and so on, and the value of n is changed every print job.

Incidentally, it is also possible to change the value of the image writing timing G within the range of not adversely affecting considerably the time until one sheet of the transfer material is discharged.

As described above, the value of I is changed, so that the contact position of the developing roller (4*aa* to 4*dd*) of each developing device on the photosensitive drum 1 is changed. As a result, the photosensitive drum 1 is not damaged mechanically or is not damaged electrically to result in rubbing memory or the like, due to the contact impact or the contact repetition at the time of contact when the developing roller (4*aa* to 4*dd*) of each developing device always contacts the photosensitive drum 1 at the substantially same position. Therefore, a degree of image defect such as latent stripes or the like caused by these damages can be alleviated without increasing cost. Further, the photosensitive drum 1 fluctuates in speed due to the contact impact during the contact.

As a result, the photosensitive drum 1 is not damaged mechanically or is not damaged electrically to result in rubbing memory or the like, due to the rubbing or repetition of rubbing caused between the photosensitive drum 1 and the intermediary transfer belt 10 in the primary transfer nip N1. Therefore, a degree of image defect such as latent stripes or the like caused by these damages can be alleviated without increasing cost. Further, the photosensitive drum 1 fluctuates in speed due to the contact impact during the contact.

Further, the contact position of the developing roller (4*aa* to 4*dd*) of each developing device with the photosensitive drum 1 is changed and distributed, so that durability of the photosensitive drum 1 can be improved.

Further, the circumferential length of the intermediary transfer belt 10 is configured to the substantially the integer multiple of the circumferential length of the photosensitive drum 1, so that the degree of the color misregistration is not worsen. Further, the cost is also not increased.

Thus, according to the present invention, it is possible to alleviate the image defect such as lateral stripes or the like caused by mechanical damage of the image bearing member surface or electrical damage of the image bearing member surface leading to rubbing memory or the like which are caused due to the contact impact or the contact repetition at the time of contact when the developing member of each of the plurality of developing devices always contacts the image bearing member at the substantially same position.

Further, according to the present invention, it is possible to alleviate the image defect such as lateral stripes or the like caused by mechanical damage of the image bearing member surface or electrical damage of the image bearing member surface leading to rubbing memory or the like which are caused due to the rubbing or the repetition of rubbing caused at the contact position between the image bearing member and the intermediary transfer member by the change in speed of the image bearing member due to the contact impact during the contact.

Further, according to the present invention, the contact position of the developing member of each of the plurality of developing devices with the image bearing member is distributed, so that the durability of the image bearing member is improved.

Further, according to the present invention, the cost is not increased and the color misregistration is also not caused to occur.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 317226/2008 filed Dec. 12, 2008, which is hereby incorporated by reference.

What is claimed is:

1. An image forming apparatus comprising:

an image bearing member;

a plurality of developing devices, contactable to said image bearing member, for developing a latent image on said image bearing member with toner;

a rotatable member for rotatably supporting said plurality of developing devices;

a detecting device for detecting a position of said image bearing member, wherein on the basis of an output of said detecting device, said rotatable member is rotated; and a control device for changeably controlling a period from timing of detection by said detecting device to timing of contact of one of said plurality of developing device, rotated by said rotatable member, to said image bearing member.

2. An apparatus according to claim 1, wherein said control device changes the period in an image forming job unit.

3. An apparatus according to claim 1, wherein a toner image on said image bearing member is to be formed on a recording material, and wherein said control device changes the period in a recording material unit during continuous image formation.

4. An apparatus according to claim 1, wherein toner images of a plurality of colors on said image bearing member are to be formed on a single recording material, and wherein said control device changes the period in the color of the toner images on the single recording material.

5. An apparatus according to claim 1, wherein said control device changes timing of rotation start of said rotatable member on the basis of the timing of detection by said detecting device.

6. An image forming apparatus comprising:

an image bearing member;

a plurality of developing devices, contactable to said image bearing member, for developing a latent image on said image bearing member with toner;

a rotatable member for rotatably supporting said plurality of developing devices;

an intermediary transfer member onto which a toner image formed on said image bearing member is to be transferred, wherein the toner image on said intermediary transfer member is to be transferred onto a recording material;

a detecting device for detecting a position of said intermediary transfer member, wherein on the basis of an output of said detecting device, said rotatable member is rotated; and a control device for changeably controlling a period from timing of detection by said detecting device to timing of contact of one of said plurality of developing device, rotated by said rotatable member, to said image bearing member.

7. An apparatus according to claim 6, wherein said image bearing member and said intermediary transfer member has an endless shape, and wherein said intermediary transfer member has a circumferential length which is an integer multiple of or a substantially integer multiple of a circumferential length of said image bearing member.

8. An apparatus according to claim 6, further comprising a driving source for driving said image bearing member and said intermediary transfer member.

9. An apparatus according to claim 6, wherein said control device changes the period in an image forming job unit.

10. An apparatus according to claim 6, wherein a toner image on said image bearing member is to be formed on the recording material, and wherein said control device changes the period in a recording material unit during continuous image formation.

11. An apparatus according to claim 6, wherein toner images of a plurality of colors on said image bearing member are to be formed on a single recording material, and wherein said control device changes the period in the color of the toner images on the single recording material.

12. An apparatus according to claim 6, wherein said control device changes timing of rotation start of said rotatable member on the basis of the timing of detection by said detecting device.

* * * * *